United States Patent [19]

Franco

[11] 3,951,714

[45] Apr. 20, 1976

[54] METHOD OF MANUFACTURING A DECORATIVE FLOOR COVERING

[75] Inventor: Alfredo A. Franco, Willow Street, Pa.

[73] Assignee: Armstrong Cork Company, Lancaster, Pa.

[22] Filed: June 10, 1974

[21] Appl. No.: 477,802

Related U.S. Application Data

[63] Continuation of Ser. No. 62,964, Aug. 11, 1970, abandoned.

[52] U.S. Cl. ..... 156/62.2; 156/277; 156/279; 427/195; 427/197; 427/282; 428/206

[51] Int. Cl.[2] ..... B05D 3/02; B05D 3/12

[58] Field of Search ..... 117/9, 13, 21; 156/62.2, 277, 279; 161/3, 5, 6, 162, 413; 427/195, 197, 282; 428/206, 207

[56] References Cited

UNITED STATES PATENTS

| | | | |
|---|---|---|---|
| 3,239,364 | 3/1966 | Carlisle et al. | 117/13 X |
| 3,343,975 | 9/1967 | Daneski et al. | 117/13 |

*Primary Examiner*—William A. Powell
*Assistant Examiner*—Jerome Massie

[57] ABSTRACT

A floor covering is made with a backing and a wear layer construction which has areas either transparent or translucent. The wear layer is formed by laying up a pattern by way of stenciling apparatus. The backing layer has printed thereon a decorative pattern. Registration exists between the decorative pattern on the backing sheet and the stencil pattern of the wear layer so that the decorative pattern on the backing will give a three-dimensional effect to the stencil pattern of the wear layer.

1 Claim, 3 Drawing Figures

Fig. I
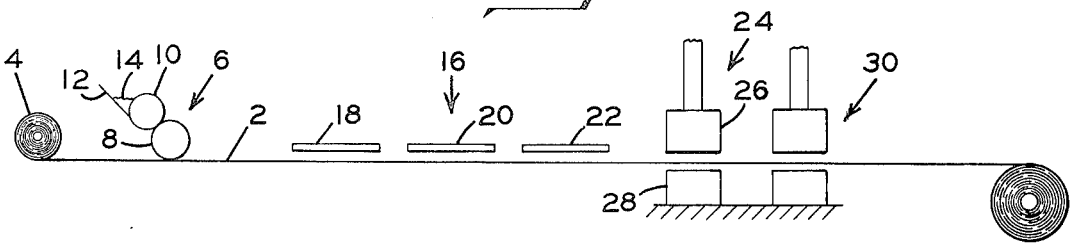
Fig. II
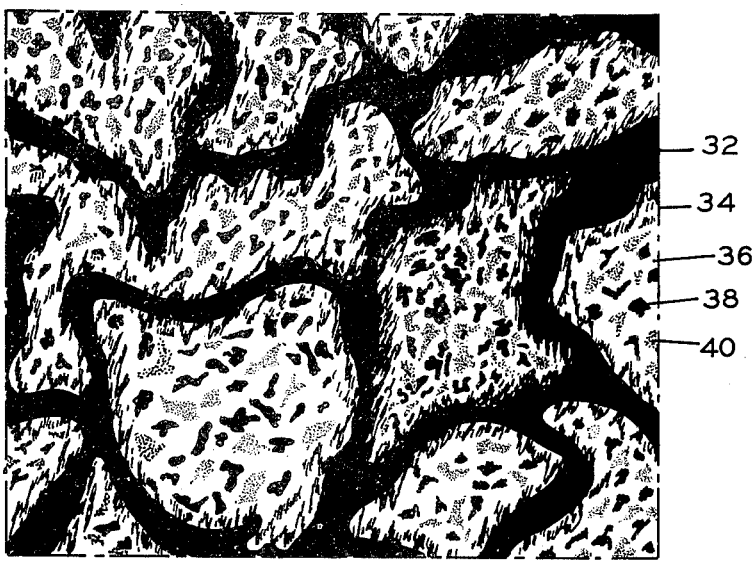
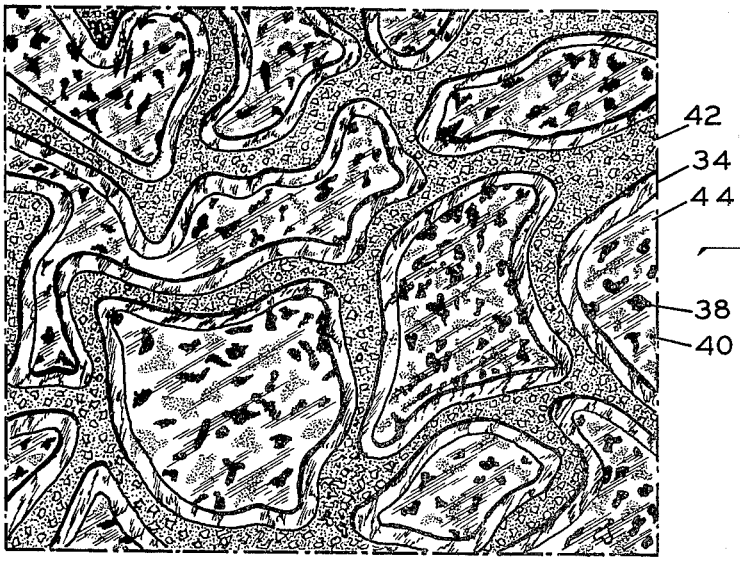
Fig. III
INVENTOR
ALFREDO A. FRANCO
ATTORNEY

METHOD OF MANUFACTURING A DECORATIVE FLOOR COVERING

This is a continuation of application Ser. No. 62,964 filed Aug. 11, 1970 now abandoned.

BACKGROUND OF THE INVENTION

1. Field of the Invention

The invention is directed to a method of making flooring, and more particularly, to a method of making a flooring with a three-dimensional effect.

2. Description of the Prior Art

U.S. Pat. No. 2,241,051 discloses one type of apparatus for laying up a stencil vinyl or stencil linoleum pattern. It has been found through the years that different design patterns can be made by using stencils. The material which will be used for the wear layer is in a granular form and provided with appropriate coloring. The materials of a different color are placed through a plurality of stencil patterns to lay up a decorative design.

U.S. Pat. No. 3,343,975, in its discussion of the prior art, indicates that opaque, transparent or translucent chips have been blended together and placed over a pigmented backing. The pigmented layer is visible through the transparent or translucent areas of the wear layer. The above patent also indicates that stencil granules of different color could be used in lieu of chips.

The prior art nowhere suggests the registration of a stencil pattern with a decorative printed pattern on the backing layer, with registration of the two to provide a coordinated effect. The printed pattern under the wear layer is coordinated with the transparent and translucent areas of the wear layer to provide a three-dimensional effect to the wear layer material.

SUMMARY OF THE INVENTION

A floor covering is composed of two parts, a backing layer and a wear layer. The backing layer is any conventional backing layer such as has been used in the past in the art. The only requirement for the backing layer is that its surface which will be in contact with the wear layer be capable of receiving the printed pattern thereon. Such backings are old as was mentioned in U.S. Pat. No. 3,343,975. The wear layer is produced by a stenciling technique wherein the different parts of the decoratively designed wear layer are laid up by passing granular material through different stencil patterns. The decorative design which is printed on the backing layer is coordinated with the stencil design which will be laid up to form the wear layer. A coordination of the two designs is utilized so that the printing on the backing layer will be visible through selected areas of the wear layer in such a manner as to provide a three-dimensional effect to the wear layer material and to provide a coloring for the wear layer material without the need of using an extensive stencil structure or a complex blend of granular materials in the stencils.

BRIEF DESCRIPTION OF THE DRAWING

FIG. 1 is a schematic showing of the processing operation;

FIG. 2 is a top view of a printed backing;

FIG. 3 is a top view of the finished flooring having the wear layer and backing layer.

DESCRIPTION OF THE PREFERRED EMBODIMENT

Referring to FIG. 1, there is shown schematically the apparatus which is utilized in carrying out the invention herein. An appropriate backing material is fed from a roll structure 4 so that it is moving in a horizontal plane. A printer 6 places a decorative design on the upper surface of the backing layer 2. The printing structure is composed of a printing roller 8 and an ink transfer roller 10 which has adjacent thereto a doctor blade 12. The doctor blade 12 retains the reservoir of ink 14 adjacent the transfer roll 10 and controls the quantity of ink which is carried by the surface of the transfer roll. The ink moves from the transfer roll to the printing roll 8 and is then placed upon the backing 2 in some type of decorative pattern. With a flat bed stencil technique, a flat bed screen printer would preferably be used. With a continuous circular stencil, a circular roll printer could be used. The backing with the decorative pattern then moves to a stencil apparatus 16. In the embodiment shown there is utilized three stencil plates 18, 20 and 22. Each stencil plate has a slightly different pattern and the vinyl granules pass through the stencil plate and are deposited upon the surface of the backing 2 in some type of prearranged pattern. By the time that the backing material passes beyond stencil 22, the total of the surface of the backing has been covered with granules of material in a prearranged pattern. The sheet material and backing now pass on to a first consolidation press 24. This is nothing more than a simple press structure which has a movable press plate 26 and a back-up press plate 28. The backing layer with its stencil granules are partially consolidated in the first press. The sheet then passes on to the second press 30 which completes the consolidation process and may even emboss the wear layer of the floor covering. The combination of pressure and heat converts the granules of material into a unitary sheet-type wear layer. Also, this bonds the wear layer to the backing layer. After a brief cooling, the sheet material is then rolled up.

The important thing herein is to have registration between the pattern which is printed on the backing and the stencil pattern which is laid up. Referring now to FIG. 2, there is shown a piece of backing material onto which has been printed a decorative pattern. The pattern has a dark area 32 which will be a solid black. Next to this there is an area 34 which is a blend of black areas and light areas to provide the effect of a fade-out of the black areas as one moves from the black area 32 into a white area 36. The white area 36 is nothing more than the natural color of the backing sheet. There may also be provided spot-like patterns 38, which are dark and 40, which are light. The printed decorative pattern could be various shades of black and white or could be multicolored.

Referring now to FIG. 3 there is shown the finished flooring. Over top of the decorative printed pattern there is laid a stencil pattern which is in registry with the printed pattern. The wear layer has a grout area 42 and areas 44 which are either transparent or translucent. The grout areas 42 are in register with the black areas 32 of the backing. Since the grout areas in most cases are opaque, the black will not show through at all. However, it is possible that the grout areas 42 could be translucent or transparent and the black underlying coating 32 would make these grout areas 42 appear to be opaque. The spot areas 38 and 40 appear as light discolorations in back of the wear layer. Thus, the wear layer surface tends to appear to have spots or imperfections in it and also the fact that the printing is spaced from the upper surface of the wear layer there is yielded a three-dimensional effect. The area 34 provides a shade transition from the grout area 42 into the translucent or transparent area 44. Thus, there can be provided a translucent area 44 which appears to have a darkly shaded edge structure with a much lighter center structure, the center structure having a spot or imperfection pattern therein. Of course, other patterns can be made, such as a center printed design covered with a clear wear layer and a decorative surrounding wear layer.

What is claimed is:

1. A process for providing a decorative floor covering comprising the steps of:

a. printing on the backing layer a decorative pattern consisting of different design elements, said printed design elements are provided as a dark printed area, a light area with spot-like patterns thereon, and a fade-out area between the dark printed area and light area wherein there is a blend of the dark printed areas and light areas to provide the effect of a fade out of the dark area as one moves from the dark area into the light area, b. passing the backing layer with its decorative pattern through a stenciling apparatus to lay up on the decorative pattern of the backing a plurality of at least translucent granules of material arranged in a decorative pattern of plural design elements, said design elements being determined by the stenciling apparatus, c. stenciling the design elements of the stenciled pattern relative to the design elements of the decorative printed pattern on the backing layer to secure registry of the printed design elements with the stenciled design elements, said stenciled design elements are provided as a grout-simulation design which is placed over the dark printed area and a translucent area which is printed over the light area and fade-out area in registry therewith, and d. consolidating the granules of material into a sheet-type wear layer of different design elements and consolidating these to the backing layer to form an end product which is composed of a backing layer and wear layer with the design elements of the wear layer in registry with and coordinated with the design elements of the decorative pattern printed on the backing layer so that certain printed design elements can be visible through selected stenciled design elements.

* * * * *